US010612311B2

(12) United States Patent
Duerholt

(10) Patent No.: US 10,612,311 B2
(45) Date of Patent: Apr. 7, 2020

(54) EARTH-BORING TOOLS UTILIZING ASYMMETRIC EXPOSURE OF SHAPED INSERTS, AND RELATED METHODS

(71) Applicant: Baker Hughes, a GE company, LLC, Houston, TX (US)

(72) Inventor: Ralf Duerholt, Selfoss (IS)

(73) Assignee: Baker Hughes, A GE Company, LLC, Houston, TX (US)

( * ) Notice: Subject to any disclaimer, the term of this patent is extended or adjusted under 35 U.S.C. 154(b) by 271 days.

(21) Appl. No.: 15/662,575

(22) Filed: Jul. 28, 2017

(65) Prior Publication Data

US 2019/0032414 A1 Jan. 31, 2019

(51) Int. Cl.

| | |
|---|---|
| ***E21B 10/55*** | (2006.01) |
| ***E21B 10/43*** | (2006.01) |
| ***E21B 10/567*** | (2006.01) |
| ***E21B 10/54*** | (2006.01) |

(52) U.S. Cl.

CPC ..... *E21B 10/55* (2013.01); *E21B 10/43* (2013.01); *E21B 10/567* (2013.01); *E21B 2010/545* (2013.01)

(58) Field of Classification Search

CPC ..... E21B 10/43; E21B 10/54; E21B 10/5673; E21B 2010/545; E21B 2010/425; E21B 10/16; E21B 10/42; E21B 10/46; E21B 10/485; E21B 10/55; E21B 10/56; E21B 10/58; E21B 10/52

See application file for complete search history.

(56) References Cited

U.S. PATENT DOCUMENTS

| | | | |
|---|---|---|---|
| 4,815,342 | A | 3/1989 | Brett et al. |
| 4,932,484 | A | 6/1990 | Warren et al. |
| 4,981,184 | A | 1/1991 | Knowlton et al. |
| 5,010,789 | A | 4/1991 | Brett et al. |
| 5,042,596 | A | 8/1991 | Brett et al. |

(Continued)

OTHER PUBLICATIONS

International Written Opinion for International Application No. PCT/US2018/043249 dated Oct. 1, 2018, 5 pages.

(Continued)

*Primary Examiner* — David J Bagnell
*Assistant Examiner* — Jonathan Malikasim
(74) *Attorney, Agent, or Firm* — TraskBritt

(57) ABSTRACT

An earth-boring tool includes a body, blades extending longitudinally and generally radially from the body, and primary cutting elements located on each blade. The earth-boring tool may include a group of at least two adjacent blades comprising the primary cutting elements and one or more first shaped inserts located rotationally behind the primary cutting elements, and one or more additional blades comprising the primary cutting elements and one or more second shaped inserts located rotationally behind the primary cutting elements, the second shaped inserts exhibiting a greater exposure relative to the first shaped inserts. Distribution of the second shaped inserts relative to the longitudinal axis may be asymmetric with respect to the longitudinal axis of the body. Methods include drilling a subterranean formation including engaging a formation with the primary cutting elements, the first shaped inserts, and the second shaped inserts of the earth-boring tool.

22 Claims, 5 Drawing Sheets

(56) References Cited

U.S. PATENT DOCUMENTS

| | | | | |
|---|---|---|---|---|
| 5,090,492 | A | 2/1992 | Keith | |
| 5,099,929 | A | 3/1992 | Keith et al. | |
| 5,099,934 | A | 3/1992 | Barr | |
| 5,109,935 | A | 5/1992 | Hawke | |
| 5,111,892 | A | 5/1992 | Sinor et al. | |
| 5,119,892 | A | 6/1992 | Clegg et al. | |
| 5,131,478 | A | 7/1992 | Brett et al. | |
| 5,163,524 | A | 11/1992 | Newton, Jr. et al. | |
| 5,165,494 | A | 11/1992 | Barr | |
| 5,186,268 | A | 2/1993 | Clegg | |
| 5,402,856 | A | 4/1995 | Warren et al. | |
| 5,549,171 | A | 8/1996 | Mensa-Wilmot et al. | |
| 5,551,522 | A | 9/1996 | Keith et al. | |
| 5,558,170 | A | 9/1996 | Thigpen et al. | |
| 5,582,261 | A | 12/1996 | Keith et al. | |
| 5,873,422 | A | 2/1999 | Hansen et al. | |
| 5,937,958 | A | 8/1999 | Mensa-Wilmot et al. | |
| 6,039,131 | A | 3/2000 | Beaton | |
| 6,164,394 | A | 12/2000 | Mensa-Wilmot et al. | |
| 6,308,790 | B1 | 10/2001 | Mensa-Wilmot et al. | |
| 6,332,503 | B1 | 12/2001 | Pessier et al. | |
| 6,408,958 | B1 * | 6/2002 | Isbell | E21B 10/43 175/431 |
| 6,615,934 | B2 | 9/2003 | Mensa-Wilmot | |
| 7,621,348 | B2 | 11/2009 | Hoffmaster et al. | |
| 7,762,355 | B2 * | 7/2010 | McClain | E21B 10/55 175/431 |
| 8,061,455 | B2 * | 11/2011 | Beuershausen | E21B 10/62 175/381 |
| 8,127,869 | B2 | 3/2012 | Vempati et al. | |
| 8,448,725 | B2 * | 5/2013 | Mensa-Wilmot | E21B 10/46 175/428 |
| 8,505,634 | B2 | 8/2013 | Lyons et al. | |
| 8,794,356 | B2 | 8/2014 | Lyons et al. | |
| 8,851,207 | B2 | 10/2014 | Gavia et al. | |
| 8,854,373 | B2 | 10/2014 | Pessier et al. | |
| 8,925,654 | B2 | 1/2015 | Zahradnik | |
| 9,051,795 | B2 | 6/2015 | Hall et al. | |
| 9,366,090 | B2 | 6/2016 | Azar et al. | |
| 2007/0278014 | A1 | 12/2007 | Cariveau | |
| 2011/0192651 | A1 | 8/2011 | Lyons et al. | |
| 2012/0118642 | A1 | 5/2012 | Vempati et al. | |
| 2013/0153305 | A1 | 6/2013 | Chrest | |
| 2015/0322727 | A1 | 11/2015 | Do et al. | |
| 2016/0230472 | A1 | 8/2016 | Bilen et al. | |
| 2016/0273273 | A1 | 9/2016 | Hinz et al. | |
| 2017/0159370 | A1 | 6/2017 | Evans et al. | |

OTHER PUBLICATIONS

International Search Report for International Application No. PCT/US2018/043249 dated Oct. 1, 2018, 4 pages.

Vempati et al., Cutting Elements, Earth-Boring Tools Including the Cutting Elements, and Methods of Forming the Cutting Elements, U.S. Appl. No. 15/374,891, filed Dec. 9, 2016.

* cited by examiner

EARTH-BORING TOOLS UTILIZING ASYMMETRIC EXPOSURE OF SHAPED INSERTS, AND RELATED METHODS

TECHNICAL FIELD

Embodiments of the present disclosure relate to earth-boring tools utilizing asymmetric exposure of shaped inserts, and related methods.

BACKGROUND

Earth-boring tools are used to form boreholes (e.g., wellbores) in subterranean formations. Such earth-boring tools include, for example, drill bits, reamers, mills, etc. For example, a fixed-cutter earth-boring rotary drill bit (often referred to as a "drag" bit) generally includes a plurality of cutting elements secured to a face of a bit body of the drill bit. The cutting elements are fixed in place when used to cut formation materials. A conventional fixed-cutter earth-boring rotary drill bit includes a bit body having generally radially projecting and longitudinally extending blades. During drilling operations, the drill bit is positioned at the bottom of a well borehole and rotated as weight-on-bit (WOB) is applied.

A plurality of cutting elements is positioned on each of the blades. The cutting elements commonly comprise a "table" of superabrasive material, such as mutually bound particles of polycrystalline diamond, formed on a supporting substrate of a hard material, such as cemented tungsten carbide. Such cutting elements are often referred to as "polycrystalline diamond compact" (PDC) cutting elements. The plurality of PDC cutting elements may be fixed within cutting element pockets formed in each of the blades (e.g., formed in rotationally leading surfaces of each of the blades). Conventionally, a bonding material, such as a braze alloy, may be used to secure the cutting elements to the bit body. One or more surfaces of the cutting table act as a cutting face of the cutting element. During a drilling operation, one or more portions of the cutting face are pressed into a subterranean formation. As the earth-boring tool moves (e.g., rotates) relative to the subterranean formation, the cutting table drags across surfaces of the subterranean formation and the cutting face removes (e.g., shears, cuts, gouges, crushes, etc.) a portion of formation material.

Rotary drill bits carrying such PDC cutting elements have proven very effective in achieving high rates of penetration in drilling subterranean formations exhibiting low to medium hardness. In harder subterranean formations, the WOB applied on a downhole tool, such as a PDC bit, and similarly the torque-on-bit (TOB) applied to the tool, are typically limited to protect the PDC cutting elements. In order to obtain higher rate-of-penetration (ROP) in hard subterranean formations, PDC bits may be used at increased rates of rotation (i.e., increased revolutions per minute (RPM)). At higher RPMs, however, the bit may become particularly prone to dynamic dysfunctions caused by instability of the bit, which may result in damage to the PDC cutting elements, the bit body, or both.

Adjustments may be made to the bit structure in order to increase drilling efficiency while reducing mechanical specific energy (MSE) (i.e., the amount of energy required to remove a given volume of rock). Improvements in stability of rotary drill bits have reduced prior, notable tendencies of such bits to vibrate in a deleterious manner. Several approaches to realizing drilling stability have been independently practiced on bits, including anti-whirl or high-imbalance designs, low-imbalance designs, and kerfing.

One approach for increasing stability involves configuring the rotary drill bit with a selected imbalance force configuration and is conventionally referred to as a so called "anti-whirl" bit. Bit "whirl" is a phenomenon wherein the bit precesses around the wellbore and against the side wall in a direction counter to the direction in which the bit is being rotated. Whirl may result in a borehole of enlarged (over gauge) dimension and out of round shape and may also result in damage to the cutters and the drill bit. A so called anti-whirl design or high-imbalance concept typically endeavors to generate an imbalance force (i.e., the imbalance force being the summation of each of the drilling forces generated by each of the cutting elements disposed on a rotary drill bit) that is directed toward a gage pad or bearing pad that slidingly engages the wall of the borehole. Such a configuration may tend to stabilize a rotary drill bit as it progresses through a subterranean formation.

Various other methods and equipment have been proposed to enhance (e.g., magnify) the natural imbalance forces, including using dynamically balanced lower drillstring assemblies and realigning the cutters to enhance the imbalance forces.

BRIEF SUMMARY

In one embodiment of the disclosure, an earth-boring tool includes a body having a longitudinal axis, blades extending longitudinally and generally radially from the body, and primary cutting elements located on each blade. The earth-boring tool may include a group of at least two adjacent blades, each blade of the group of at least two adjacent blades comprising the primary cutting elements proximate a front cutting edge of the blades and one or more first shaped inserts located rotationally behind the primary cutting elements. The earth-boring tool may also include one or more additional blades comprising the primary cutting elements proximate the front cutting edge of the blades and one or more second shaped inserts located rotationally behind the primary cutting elements, the second shaped inserts exhibiting a greater exposure relative to the first shaped inserts. Distribution of the second shaped inserts relative to the longitudinal axis may be asymmetric with respect to the longitudinal axis of the body. The group of at least two adjacent blades may be entirely free of the second shaped inserts.

In another embodiment of the disclosure, a method of drilling a subterranean formation includes applying weight-on-bit to an earth-boring tool substantially along a longitudinal axis thereof and rotating the earth-boring tool. The method may include engaging a formation with primary cutting elements, one or more first shaped inserts, and one or more second shaped inserts of the earth-boring tool, the second shaped inserts exhibiting a greater exposure relative to the first shaped inserts, wherein each blade of a group of at least two adjacent blades comprises the primary cutting elements proximate a front cutting edge of the blades and the first shaped inserts located rotationally behind the primary cutting elements while one or more additional blades comprise the primary cutting elements proximate the front cutting edge of the blades and the second shaped inserts located rotationally behind the primary cutting elements, the group of at least two adjacent blades being entirely free of the second shaped inserts. The method may also include enhancing imbalance forces acting on the earth-boring tool using a distribution of the second shaped inserts relative to the longitudinal axis that is asymmetric with respect to the longitudinal axis.

In a further embodiment of the disclosure, a method of drilling a subterranean formation includes applying weight-on-bit to an earth-boring tool substantially along a longitudinal axis thereof and rotating the earth-boring tool. The method may include engaging a formation with primary cutting elements and at least one shaped insert located on blades of the earth-boring tool, wherein each blade comprises the plurality of primary cutting elements proximate a front cutting edge of the blades and a single blade comprises a single shaped insert located rotationally behind the plurality of primary cutting elements while all other blades remain entirely free of the at least one shaped insert. The method may also include enhancing imbalance forces acting on the earth-boring tool using a distribution of the second shaped inserts relative to the longitudinal axis that is asymmetric with respect to the longitudinal axis.

BRIEF DESCRIPTION OF THE DRAWINGS

While the specification concludes with claims particularly pointing out and distinctly claiming what are regarded as embodiments of the present disclosure, various features and advantages of disclosed embodiments may be more readily ascertained from the following description when read with reference to the accompanying drawings, in which:

DETAILED DESCRIPTION

The illustrations presented herein are not actual views of any particular earth-boring tool, drill bit, cutting element, or component of such a tool or bit, but are merely idealized representations that are employed to describe embodiments of the present disclosure.

As used herein, the term "earth-boring tool" means and includes any tool used to remove formation material and form a bore (e.g., a wellbore) through the formation by way of removing the formation material. Earth-boring tools include, for example, rotary drill bits (e.g., fixed-cutter or "drag" bits and roller cone or "rock" bits), hybrid bits including both fixed cutters and roller elements, coring bits, bi-center bits, reamers (including expandable reamers and fixed-wing reamers), and other so-called "hole-opening" tools, etc.

As used herein, the term "cutting element" means and includes any element of an earth-boring tool that is configured to cut or otherwise remove formation material when the earth-boring tool is used to form or enlarge a bore in the formation.

As used herein, the term "shaped insert" means and includes any element of an earth-boring tool that includes a cutting table substantially presenting an arcuate cutting face oriented on a blade of an earth-boring tool in a direction of intended rotation of the tool.

As used herein, the term "and/or" includes any and all combinations of one or more of the associated listed items.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Figure 1:
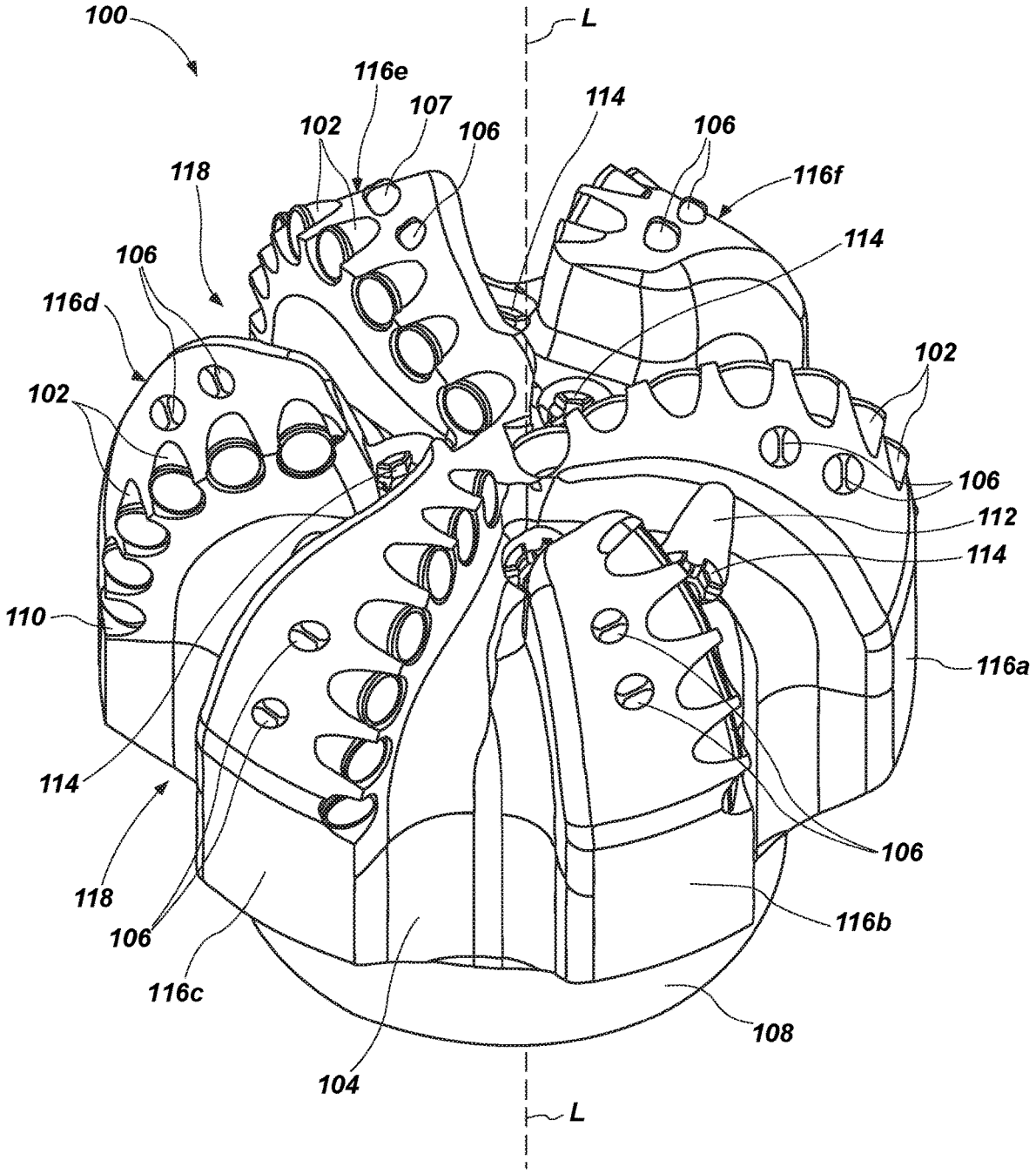
FIG. 1 is a perspective view of an earth-boring drill bit including asymmetric exposure of shaped inserts of the disclosure.

FIG. 1 is a perspective view of an embodiment of an earth-boring tool 100 of the present disclosure. The earth-boring tool 100 of FIG. 1 is configured as an earth-boring rotary drill bit. The earth-boring tool 100, more specifically, comprises a drag bit having a plurality of primary cutting elements 102 (also referred to herein as a "cutting elements 102" for simplicity) disposed within pockets 110 and affixed to a body 104 of the earth-boring tool 100. The earth-boring tool 100 also includes one or more first shaped inserts 106 and one or more second shaped inserts 107 affixed to the body 104. The shaped inserts 106, 107 may include a non-planar, convex cutting table not having a flat cutting face (e.g., dome-shaped, cone-shaped, chisel-shaped, etc.). The second shaped inserts 107 may exhibit a greater exposure relative to an exposure of the first shaped inserts 106, as discussed in further detail below. The present disclosure relates to embodiments of earth-boring tools utilizing asymmetric distribution (e.g., placement) of the second shaped inserts 107 relative to a longitudinal axis L of the body 104 to improve stability of the drill bit by enhancing (e.g., magnifying) imbalance forces during drilling operations.

The body 104 of the earth-boring tool 100 may be secured to a shank 108 having a threaded connection portion (not shown), which may conform to industry standards, such as those promulgated by the American Petroleum Institute (API), for attaching the earth-boring tool 100 to a drill string (not shown). The body 104 may include internal fluid passageways that extend between fluid ports 112 at the face of the body 104 and a longitudinal bore that extends through the shank 108 and partially through the body 104. Nozzle inserts 114 may be secured within the fluid ports 112 of the internal fluid passageways. The body 104 may include a plurality of blades 116 (e.g., blades 116*a* through 116*f*) that are separated by fluid courses 118, portions of which, along the gage of the earth-boring tool 100, may be referred to in the art as "junk slots." While the earth-boring tool 100, as depicted in the embodiment of FIG. 1, includes six blades (i.e., three primary blades and three secondary blades), it is to be recognized that the earth-boring tool 100 may have fewer or greater number of blades. The first shaped inserts 106 may be selectively substituted (e.g., replaced) with the second shaped inserts 107 on specific blades 116 (e.g., one or more blades) of the body 104 in order to improve stability of the earth-boring tool 100. An exposure of each of the shaped inserts 106, 107 may be defined as the maximum distance to which the shaped inserts 106, 107 may extend into the formation before a surface of the blade 116 to which the shaped inserts 106, 107 is mounted begins to ride or rub on the formation. In other words, the exposure of the shaped inserts 106, 107 may be defined by a distance that each of the shaped inserts 106, 107 extends or projects over the surface of the blade 116 to which it is mounted. In some embodiments, second shaped inserts 107 may be configured to engage formation material at a point deeper in the formation than the first shaped inserts 106. That is, the second shaped inserts 107 may have an over-exposure to the formation with respect to the first shaped inserts 106.

The cutting elements 102 may comprise PDC cutting elements including a diamond table secured to a supporting substrate of a hard material, such as cemented tungsten carbide. It is also contemplated that the table may, alternatively be formed of cubic boron nitride. In some embodiments, the cutting elements 102 may each comprise a disc-shaped diamond table on an end surface of a generally cylindrical cemented carbide substrate and having a substantially planar cutting face opposite the substrate and, in some embodiments, may be configured to be a shearing cutting element. In other embodiments, the cutting face topography of the cutting faces of the cutting elements 102, or portions thereof, may be non-planar. Further, cutting faces of the cutting elements 102 may include one or more adjacent peripheral chamfered cutting edges. The first shaped inserts 106 and/or the second shaped inserts 107 may also comprise PDC cutting elements including a diamond table secured to a supporting substrate of a hard material such as for example, a cemented tungsten carbide, a metal, a metal alloy, or a ceramic-metal composite material. Further, for some applications, the supporting substrate alone may be configured with a non-planar cutting face, and such cutting face may be coated with diamond or diamond-like carbon applied by conventional processes. In addition and by way of example only, the shaped inserts 106, 107 may comprise one or more of another superabrasive material in the form of natural diamond, thermally stable polycrystalline diamond, and cubic boron nitride on a supporting substrate of any of the aforementioned materials. The first shaped inserts 106 and the second shaped inserts 107 may have a non-planar (e.g., dome-shaped, cone-shaped, chisel-shaped, etc.) cutting face and, in some embodiments, may be configured to be a gouging cutting element. The Assignee of the present disclosure has designed so called "shaped inserts" including a non-planar, convex cutting table (e.g., dome-shaped, cone-shaped, chisel-shaped, etc.) received in apertures in axially leading blade surfaces. U.S. Pat. No. 8,794,356, issued Aug. 5, 2014, U.S. Pat. No. 8,505,634, issued Aug. 13, 2013, and U.S. patent application Ser. No. 15/374,891, filed Dec. 9, 2016, each of which is assigned to the Assignee of the present disclosure, and the disclosure of each of which is incorporated herein in its entirety by this reference, disclose cutting elements including a cutting table exhibiting such a shaped geometry disposed within receptacles of a body of an earth-boring tool. Further, a cutting face or leading face of the cutting elements 102, the first shaped inserts 106, and/or the second shaped inserts 107 may be treated (e.g., polished) to exhibit a greatly reduced surface roughness.

One or more of the first shaped inserts 106 may be located in selected regions (e.g., nose or shoulder region) of the body 104 and may be located proximate to at least one or more of the cutting elements 102. In some embodiments, the cutting elements 102 may be positioned proximate a front cutting edge of a respective blade 116 (e.g., at a rotationally leading edge of the blade 116). One or more (e.g., two) first shaped inserts 106 may be positioned proximate one another on each of the blades 116 and may be disposed at selected locations rotationally behind the cutting elements 102 on the same blade 116.

In some embodiments, an exposure (e.g., height, back rake angle, etc.) of the cutting elements 102 and the first shaped inserts 106 may be substantially the same relative to an adjacent surface of the blade 116. In other embodiments, an exposure of the cutting elements 102 may differ from that of the first shaped inserts 106. For example, an exposure of the first shaped inserts 106 may be less than an exposure of the cutting elements 102 relative to an adjacent surface of the blade 116 (i.e., less than a depth of penetration of the cutting elements 102 into an underlying subterranean formation). More specifically, the first shaped insert 106 may be at least partially located behind and not exposed above a rotationally leading cutting element 102 secured to the same blade 116 as the first shaped insert 106. As a specific, nonlimiting example, the first shaped insert 106 may be located directly rotationally behind and at least partially within a cutting path (e.g., a kerf) traversed by the cutting element 102. In other embodiments, the first shaped inserts 106 may be located adjacent to the cutting path traversed by the cutting element 102 and positioned to directly engage the formation. In addition, the cutting elements 102 may be positioned as primary cutters along the rotationally leading edge of the blade 116, and the first shaped inserts 106 may be positioned as so-called "back up" cutters rotationally trailing the cutting elements 102. Such back up cutters may be positioned to exhibit an exposure the same as, greater than, or less than, an associated primary cutter as discussed above. In other embodiments, the first shaped inserts 106 may be positioned as primary cutters relative to the cutting elements 102 located on a rotationally behind blade 116. It may be appreciated that any combination of the cutting elements 102, the first shaped inserts 106, and/or non-cutting bearing elements may be utilized in combination in order to provide specific benefits for increased stability during drilling operations of various subterranean formations.

Further, one or more of the first shaped inserts 106 may be substituted (e.g., replaced) with one or more of the second shaped inserts 107 in order to provide stability to the body 104 during drilling operations by providing an asymmetric placement relative to the longitudinal axis L of relative exposures between the first shaped inserts 106 and the second shaped inserts 107. In some embodiments, an exposure of the second shaped inserts 107 may be greater than an exposure of the first shaped inserts 106 relative to an adjacent surface of the blade 116. In addition, an exposure of the second shaped inserts 107 may be greater than an exposure of the cutting elements 102 relative to an adjacent surface of the blade 116. In other embodiments, an exposure of the second shaped inserts 107 may be greater than an exposure of the first shaped inserts 106 while being less than an exposure of the cutting elements 102. For example, the second shaped insert 107 may be at least partially located behind and not exposed above a rotationally leading cutting element 102 secured to the same blade 116 as the second shaped insert 107. As a specific, nonlimiting example, the second shaped insert 107 may be located directly rotationally behind and at least partially within a cutting path (e.g., a kerf) traversed by the cutting element 102. In other embodiments, the second shaped inserts 107 may be located adjacent to the cutting path traversed by the cutting element 102 and positioned to directly engage the formation. In yet other embodiments, an exposure of the second shaped inserts 107 may be greater (e.g., greatly exaggerated) than that of each of the first shaped inserts 106 and the cutting elements 102. In other words, the second shaped inserts 107 may be positioned such that an exposure thereof may be much greater than any surrounding elements.

Further, utilizing asymmetric placement of the second shaped inserts 107 among remaining first shaped inserts 106 may facilitate improved stability of the drill bit by enhancing the imbalance forces during drilling operations. By way of non-limiting example, one of the first shaped inserts 106 (e.g., located in the shoulder region) may be replaced with one of the second shaped inserts 107 on only one blade 116 (e.g. blade 116*e*) as shown in FIG. 1. In other embodiments, both of the first shaped inserts 106 (e.g., located in the nose and shoulder regions) may be replaced with two of the second shaped inserts 107 on only one blade 116. For example, the first shaped inserts 106 may be replaced with the second shaped inserts 107 positioned exclusively on one blade 116. In such a configuration, two of the second shaped inserts 107 may be located on blade 116*e*, which blade may not be located adjacent to blade 116*a*, which may include the cutting element 102 positioned within a first radially innermost pocket of the blade 116*a* and proximate a longitudinal axis L of the body 104. However, it is to be appreciated that placement of the second shaped inserts 107 on a single blade 116 may vary and may be based, at least in part, on imbalance forces of a specific drill bit.

In other embodiments, one or more of the first shaped inserts 106 located on two adjacent blades 116, (e.g., blade 116*e* and blade 116*f*) may be replaced with one or more of the second shaped inserts 107. By way of non-limiting example, one of the first shaped inserts 106 located in the shoulder region of the blade 116*e* and one of the first shaped inserts 106 located in the shoulder region of the blade 116*f*, for example, may be replaced with the second shaped inserts 107. In such a configuration, the first shaped inserts 106 located in the nose region of each of the blades 116*e* and 116*f* may remain in position. Alternatively, each of the first shaped inserts 106 located in the nose region of each of the blade 116*e* and the blade 116*f* may be replaced with the second shaped inserts 107 while the first shaped inserts 106 located in the shoulder region of each of the blade 116*e* and the blade 116*f* may remain in position.

In other embodiments as described in greater detail with reference to FIG. 4, one or more (e.g., two) of the first shaped inserts 106 may be replaced with one or more (e.g., two) of the second shaped inserts 107 located on adjacent blades 116 (e.g., blade 116*e* and blade 116*f*), while all remaining blades 116 of the body 104 retain the first shaped inserts 106 and remain entirely free of the second shaped inserts 107. In other embodiments, the first shaped inserts 106 may be selectively located on additional adjacent blades 116 of the body 104. For example, the first shaped inserts 106 located on three or more adjacent blades 116 may be replaced with one or more of the second shaped inserts 107, while all other blades 116 remain entirely free of the second shaped inserts 107. In other words, selective placement of the second shaped inserts 107 on the blades 116 may result in a blade configuration that is asymmetric with respect to the longitudinal axis L. It is to be appreciated that the cutting elements 102, the first shaped inserts 106, and the second shaped inserts 107 may be positioned in any asymmetric distribution in order to provide stability to the body 104 during drilling operations.

Further, the blades 116 (e.g., blades 116*e* and/or 116*f*) containing the second shaped inserts 107 may be located on a side of the body 104 opposite from a known imbalance force acting on the body 104. In such a configuration, all other remaining blades 116 (e.g., blades 116*a* through 116*d*) may be entirely free of the second shaped inserts 107, which other blades 116 may be adjacent to the known imbalance force acting on the body 104. It may be appreciated that while the configuration of FIG. 4 specifies that the second shaped inserts 107 are located on blades 116*e* and/or 116*f*, one of ordinary skill in the art will readily appreciate that any two or more adjacent blades (e.g., opposite from the imbalance force) may include the second shaped inserts 107 in order to enhance the imbalance force acting on the body 104. In other words, selective placement of the second shaped inserts 107 may result in a blade configuration that is asymmetric with respect to the longitudinal axis L, such that a natural imbalance force of a drill bit is enhanced. For example, such an asymmetric configuration may push the drill bit against a sidewall of the borehole creating a greater side force and/or more pronounced grooving, which in turn enhances stability. Therefore, the specific embodiments of the arrangement of blades 116 are shown by way of example only, while specific tool configurations may be tailored to meet the individual requirements of each bit body. The imbalance force acting on the body 104 may be calculated using conventional methods by persons having ordinary skill in the art. Thus, it is to be recognized that the imbalance force will vary between differing drill bits and various earth-boring tools. For example, differing bit types and sizes, including differing cutting element types and placement along with differing blade configurations, will affect imbalance forces on each individual bit body. Once the magnitude and direction of the imbalance forces are calculated, the second shaped inserts 107 may be positioned on specific blades 116 to enhance (e.g., magnify) the calculated imbalance forces in order to provide increased stability to the earth-boring tool 100.

In embodiments of the present disclosure, selective placement of additional cutting elements, such as the second shaped inserts 107, may serve to enhance the imbalance forces on a given drill bit. Drilling characteristics of a particular bit, such as Stability Level, ROP and/or TOB may be enhanced by selection of the number and placement of the second shaped inserts 107 relative to the number and placement of the cutting elements 102. It is contemplated that the cutting elements 102, the first shaped inserts 106, and the second shaped inserts 107 may be selectively positioned relative to one another on the blades 116. In addition, smaller bits (e.g., 6.5 inch diameter or less drill bits) which may have limited blade surface area and/or material volume for cutting elements and/or bearing elements may employ shaped inserts according to the disclosure for enhanced stability. For example, when a single first shaped insert 106 is positioned on each of the blades 116 of a smaller bit, only one of the first shaped inserts 106 may be replaced with one of the second shaped inserts 107. Further, the number of cutters (i.e., cutter density) may remain the same or may differ from that of conventional blades in order to accommodate selective placement of the second shaped inserts 107 among the first shaped inserts 106 and the cutting elements 102. In other embodiments, as the first shaped inserts 106 are replaced with the second shaped inserts 107, placement and exposure of the cutting elements 102 may be maintained. In other words, an original bit design may not change with the exception of replacing the first shaped inserts 106 in selected locations (e.g., nose or shoulder regions) of the body 104. Finally, selective placement of the second shaped inserts 107 among shaped inserts 106 may be utilized in an asymmetric configuration on other earth-boring tools, such as, for example, drag bits having differing blade configurations (e.g., five blades), hybrid bits, and other earth-boring tools employing fixed cutting elements and which may include bodies and/or blades that are fabricated from either steel or a hard metal "matrix" material.

Figure 2:
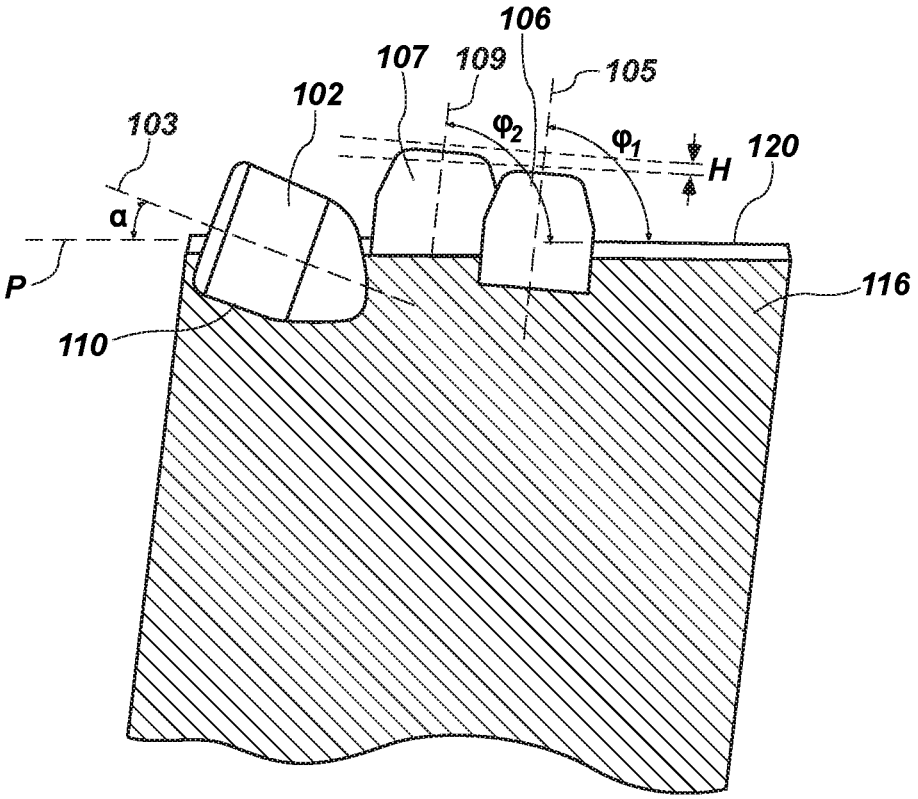
FIG. 2 is a cross-sectional view of a blade of an embodiment of the earth-boring drill bit of the disclosure.

FIG. 2 is a cross-sectional view of a blade 116. The cutting elements 102 may be disposed within the pockets 110 of the blades 116 and oriented at an angle α existing between a longitudinal axis 103 of the cutting elements 102 and a phantom line P extending from an outer surface 120 of the blades 116. By way of example and not limitation, the angle α may be within a range of from about two degrees (2°) to about forty-five degrees (45°). The first shaped inserts 106 may be positioned within the pockets 110 of the blades 116 and oriented at an angle $\phi_1$ existing between a longitudinal axis 105 of the first shaped inserts 106 and a phantom line P extending from an outer surface 120 of the blades 116. Further, the second shaped inserts 107 may be positioned within the pockets 110 of the blades 116 and oriented at an angle $\phi_2$ existing between a longitudinal axis 109 of the second shaped inserts 107 and a phantom line P extending from an outer surface 120 of the blades 116. By way of example and not limitation, the angle $\phi_1$ and the angle $\phi_2$ may be within a range of from about seventy degrees (70°) to about one hundred ten degrees (110°). In one embodiment, the angle $\phi_1$ of the first shaped inserts 106 may be about seventy-five degrees (75°), while the angle $\phi_2$ of the second shaped inserts 107 may be greater than or less than about seventy-five degrees (75°) in order to provide a differing exposure above the outer surface 120 of the blades 116. In some embodiments, a maximum exposure $E_1$ (e.g., back rake angle) of the first shaped inserts 106 may be less than a maximum exposure $E_2$ of the second shaped inserts 107. In other embodiments, back rake angles may remain the same, and the maximum exposure $E_1$ (e.g., height H) of the first shaped inserts 106 may be less than the maximum exposure $E_2$ of the second shaped inserts 107 as shown in FIG. 2. More specifically, the maximum exposure $E_1$ of the first shaped inserts 106 above the outer surface 120 (e.g., an adjacent surface) of the blades 116 may be, for example, about 0.05 in. or more less than the maximum exposure $E_2$ of the second shaped inserts 107 above the outer surface 120. As a specific, nonlimiting example, the maximum exposure $E_1$ of the first shaped inserts 106 above the outer surface 120 of the blades 116 may be, for example, about 0.1 in. or more less than the maximum exposure $E_2$ of the second shaped inserts 107 above the outer surface 120. The height H may be chosen based on a desired exposure of the second shaped inserts 107. In some embodiments, multiple second shaped inserts 107 with differing heights H may enable a drill bit supplier or drilling operator to provide varied exposures appropriate for different drilling conditions. In other embodiments, the relative height H may be effectively varied between the first shaped inserts 106 and the second shaped inserts 107 by placing one or more spacers (e.g., shims) in the bottom of the pockets 110 prior to inserting the first shaped inserts 106 or the second shaped inserts 107 enabling use of substantially identical elements.

In some embodiments, exposures among the first shaped inserts 106 may vary in order to enable each of the first shaped inserts 106 to engage the formation at a specified depth-of-cut range. In other words, differing configurations (e.g., sizes, orientations, etc.) of blades 116 may necessitate varying exposures of the first shaped inserts 106 in order to establish a consistent depth-of-cut relative to an engaged formation. For example, required exposures of the first shaped inserts 106 may include 0.015 in., 0.010 in., 0.020 in. to achieve a unified depth-of-cut of 0.200 in. However, such varied exposures among the first shaped inserts 106 is not to be equated with the second shaped inserts 107 exhibiting a greater exposure relative to the first shaped inserts 106 in order to achieve an asymmetric configuration of a bit body to improve stability of the drill bit by enhancing imbalance forces during drilling operations. Rather, the varying exposures of the first shaped inserts 106 enables symmetric placement thereof.

Figure 3:
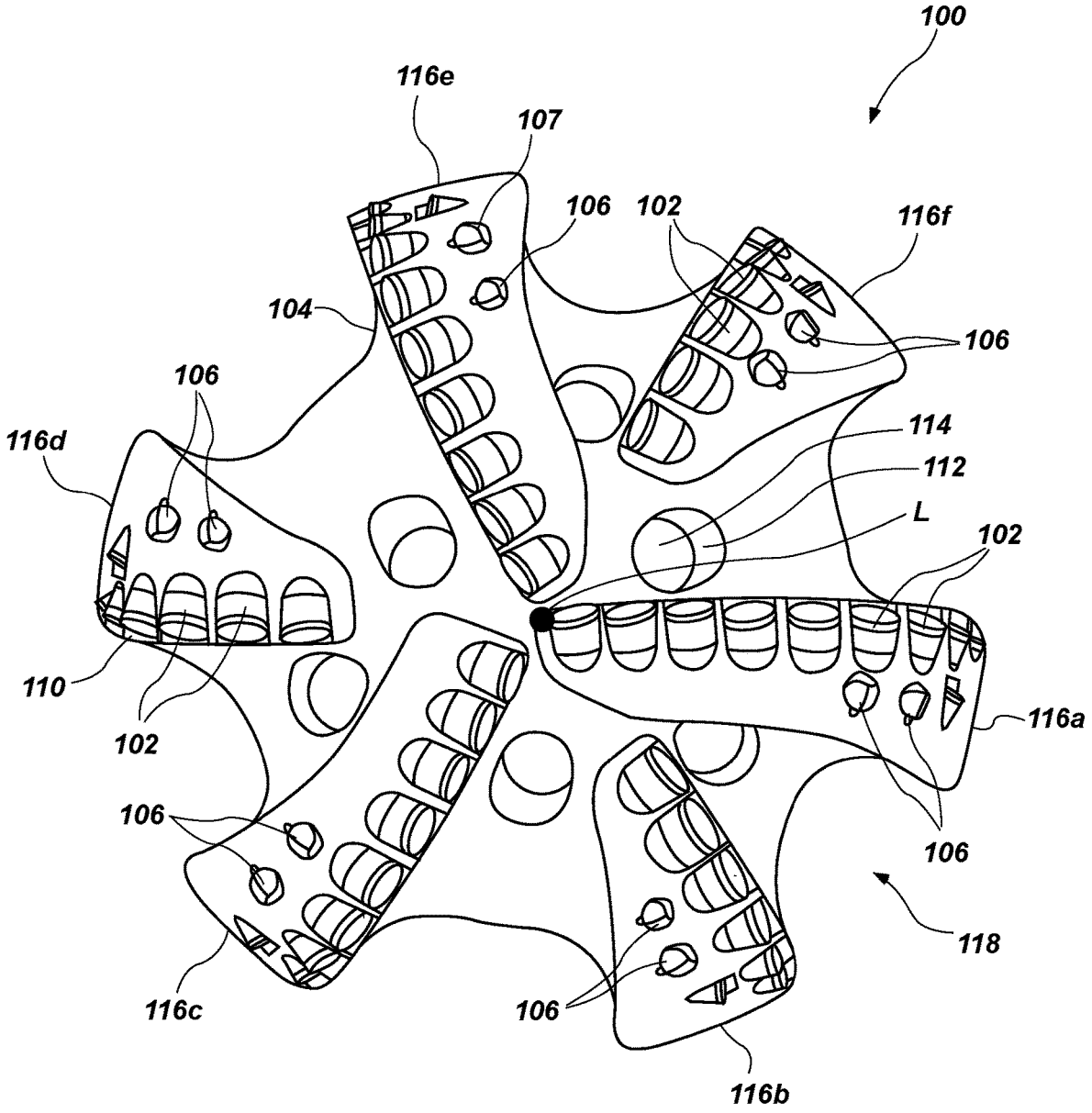
FIG. 3 is a face view of an embodiment of the earth-boring drill bit of the disclosure.

FIG. 3 is a face view illustrating the earth-boring tool 100 of FIG. 1. As discussed above, the earth-boring tool 100 comprises a drag bit having the cutting elements 102 disposed within the pockets 110 of the blades 116 (i.e., 116*a* through 116*f*) of the body 104. The earth-boring tool 100 also includes one or more of the first shaped inserts 106 and/or the second shaped inserts 107 disposed within the pockets 110 of a group of one or more blades 116 (e.g., 116*e*) as shown in FIG. 3. In such a configuration, the first shaped inserts 106 may be substituted (e.g., replaced) with the second shaped inserts 107 positioned within the pockets 110 of one or more designated blades 116 and may be located proximate to the cutting elements 102. In some embodiments, one of the first shaped inserts 106 (e.g., located in the shoulder region) may be replaced with one of the second shaped inserts 107 on only one blade 116 (e.g. blade 116*e*). In other embodiments, both of the first shaped inserts 106 (e.g., located in the nose and shoulder regions) may be replaced with two of the second shaped inserts 107 on only one blade 116. For example, the first shaped inserts 106 may be replaced with the second shaped inserts 107 positioned exclusively on one blade 116 while all other blades 116 remain free of the second shaped inserts 107. In such a configuration, one or more of the second shaped inserts 107 may be located on blade 116*e* as shown in FIG. 3. In addition, one or more rows (e.g., a single row) of the cutting elements 102 may be located proximate to the front cutting edge of each of the blades 116 (e.g., between the rotationally leading edge and the first shaped inserts 106 and/or the second shaped inserts 107) and the first shaped inserts 106 and/or the second shaped inserts 107 may be positioned to rotationally follow the cutting elements 102 on the same blade 116.

In other embodiments (not depicted), both of the first shaped inserts 106 (e.g., located in the nose and shoulder regions) may be replaced with two of the second shaped inserts 107 on one of the blades 116 (e.g., 116*e*), while only one of the first shaped inserts 106 may be replaced with one of the second shaped inserts 107 on an adjacent blade 116 (e.g., 116*f*). For example, the first shaped inserts 106 may be replaced with the second shaped inserts 107 positioned in a group of two adjacent blades 116 providing a total of three of the second shaped inserts 107, two of which are located on the blade 116*e* and one of which is located on the blade 116*f*, for example, or in any like configuration providing a total of three of the second shaped inserts 107. In such a configuration, another group of adjacent blades 116 including all remaining blades 116*a* through 116*d* retain the first shaped inserts 106 and lack any of the second shaped inserts 107.

In some embodiments, other regions (e.g., cone, flank, gage regions) of the body 104 may remain entirely free of the first shaped inserts 106 and/or the second shaped inserts 107. In other embodiments, the cone, nose, flank, shoulder, and gage regions of the body 104 may or may not include the first shaped inserts 106 and/or the second shaped inserts 107. Further, additional rows of the cutting elements 102 may be positioned in the pockets 110 and located proximate to (e.g., rotationally behind) the row of the cutting elements 102 located proximate to the front cutting edge of the blades 116. In other words, the cutting elements 102 may be positioned, either singly, in partial rows, or in full rows in additional (e.g., rotationally behind) portions of the blades 116. Thus, the first shaped inserts 106 and/or the second shaped inserts 107 may be secured in a predetermined pattern and on a predetermined set of adjacent blades 116 (i.e., on a specific side of the body 104) in order to provide an asymmetric configuration to facilitate effective cutting for the formation type to be cut along with providing stability to the earth-boring tool 100.

As previously described above, the earth-boring tool 100 may be formed to exhibit a different configuration than that depicted in FIGS. 1 and 3. By way of non-limiting example, FIG. 4 shows a face view of an additional embodiment of the earth-boring tool 100, in accordance with additional embodiments of the disclosure. To avoid repetition, not all features shown in FIG. 4 are described in detail herein. Rather, unless described otherwise below, a feature designated by a reference numeral will be understood to be substantially similar to the previously described feature.

Figure 4:
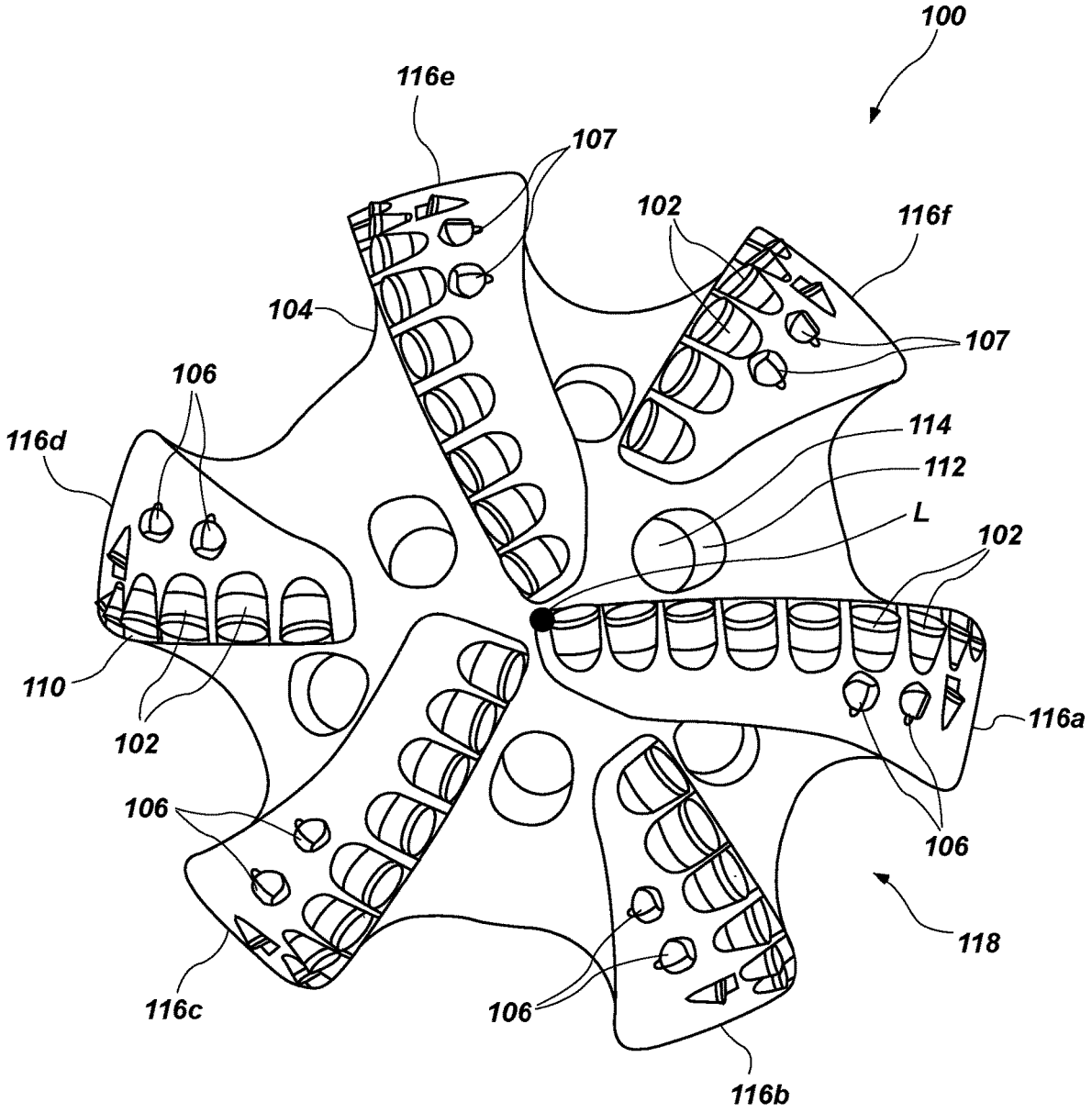
FIG. 4 is a face view of an additional embodiment of the earth-boring drill bit of the disclosure.

As shown in FIG. 4, the earth-boring tool 100 comprises a drag bit having the plurality of cutting elements 102 disposed within the pockets 110 of the plurality of blades 116 (i.e., 116*a* through 116*f*) of the body 104. The earth-boring tool 100 of FIG. 4 may be substantially similar to the earth-boring tool 100 shown in FIGS. 1 and 3, except that the earth-boring tool 100 may include one or more (e.g., two) of the first shaped inserts 106 being replaced with one or more (e.g., two) of the second shaped inserts 107 located on two adjacent blades 116 (e.g., blade 116*e* and blade 116*f*), while all remaining blades 116 of the body 104 retain the first shaped inserts 106 and remain entirely free of the second shaped inserts 107. In such a configuration, the first shaped inserts 106 may be positioned within the pockets 110 of each of designated blades 116*e* and 116*f* and may be located proximate to the cutting elements 102, providing a total of four of the second shaped inserts 107, two of which are located on each of the designated blades 116*e* and 116*f* As discussed above with reference to FIG. 3, one or more rows (e.g., a single row) of the cutting elements 102 may be located proximate to the front cutting edge of each of the blades 116 (e.g., between the rotationally leading edge and the first shaped inserts 106 and/or the second shaped inserts 107) and the first shaped inserts 106 and/or the second shaped inserts 107 may be positioned to rotationally follow the cutting elements 102 on the same blade 116. In other words and by way of example only, two of the second shaped inserts 107 may be positioned within the pockets 110 on each of the designated blades 116*e* and 116*f* of the group of two adjacent blades 116, making a total of four of the second shaped inserts 107, while another group of one or more adjacent blades 116 including all remaining blades 116*a* through 116*d* include a specified number (e.g., two each) of the first shaped inserts 106 on each of the blades 116, which blades 116 lack any of the second shaped inserts 107.

In other embodiments, each of the blades 116 may include the cutting elements 102 proximate a front cutting edge of the blades 116 and a single blade 116 may include a single first shaped insert 106 or a single second shaped insert 107 located rotationally behind the cutting elements 102 while all other blades 116 remain entirely free of the first shaped inserts 106 and/or the second shaped inserts 107. While use of such shaped inserts 106, 107 is known, asymmetric placement of a single shaped insert 106, 107 is embodied in the present disclosure. In yet other embodiments, any number of the first shaped inserts 106 may be replaced with the second shaped inserts 107 positioned in the pockets 110 and located proximate to (e.g., rotationally behind) the cutting elements 102 on the same blade 116 in order to provide an asymmetric configuration to facilitate effective cutting for the formation type to be cut along with providing stability to the earth-boring tool 100. In other words, the first shaped inserts 106 may be selectively located on additional adjacent blades 116 of the body 104 based, at least in part, on known imbalance forces acting on the body 104. For example, the first shaped inserts 106 located on three or more adjacent blades 116 may be replaced with the second shaped inserts 107, while all other blades 116 remain entirely free of the second shaped inserts 107. In other words, asymmetric placement of the first shaped inserts 106 having a differing exposure relative to an exposure of the second shaped inserts 107 on the blades 116 may result in a blade configuration that is asymmetric with respect to the longitudinal axis L. It is to be appreciated that the cutting elements 102, the first shaped inserts 106, and the second shaped inserts 107 may be positioned in any asymmetric configuration in order to provide stability to the body 104 during drilling operations.

Further, in order to improve stability of the drill bit by enhancing natural imbalance forces, the first shaped inserts 106 may be substituted (e.g., replaced) with non-cutting bearing elements (e.g., ovoids) rather than the second shaped inserts 107. Such non-cutting bearing elements may be configured as bearing or rubbing surfaces, which may act to protect a rotationally leading portion of the blades 116 from substantial wear as the blades 116 contact a subterranean formation. In such a configuration, a relative exposure of the non-cutting bearing elements may be greater than that of the first shaped inserts 106 relative to an adjacent surface of the blade 116. In other words, the non-cutting bearing elements may exhibit similar properties (e.g., locations, exposures, etc.) as that of the second shaped inserts 107, while protecting the blades and/or controlling depth-of-cut during drilling operations rather than gouging the formation.

Figure 5A:
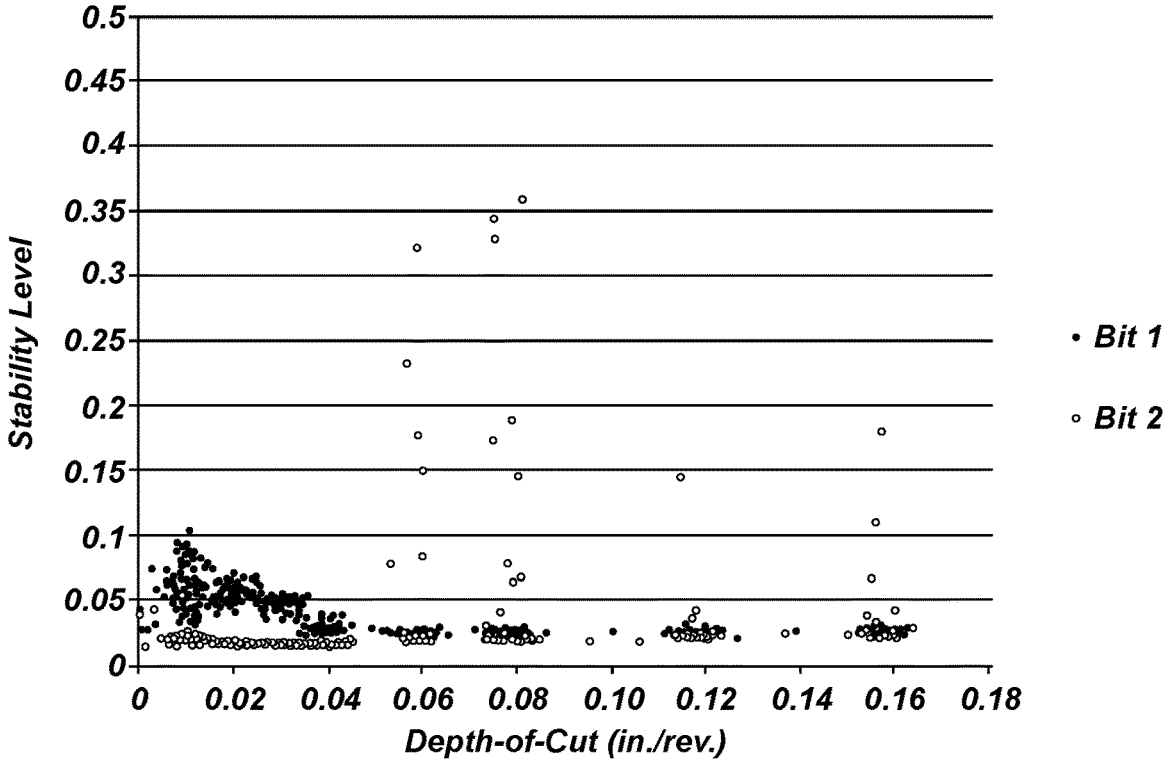
FIG. 5A is a graph depicting laboratory test results of Stability Level versus Depth-of-Cut (DOC) for tested drill bit configurations in a first representative formation.
Figure 5B:
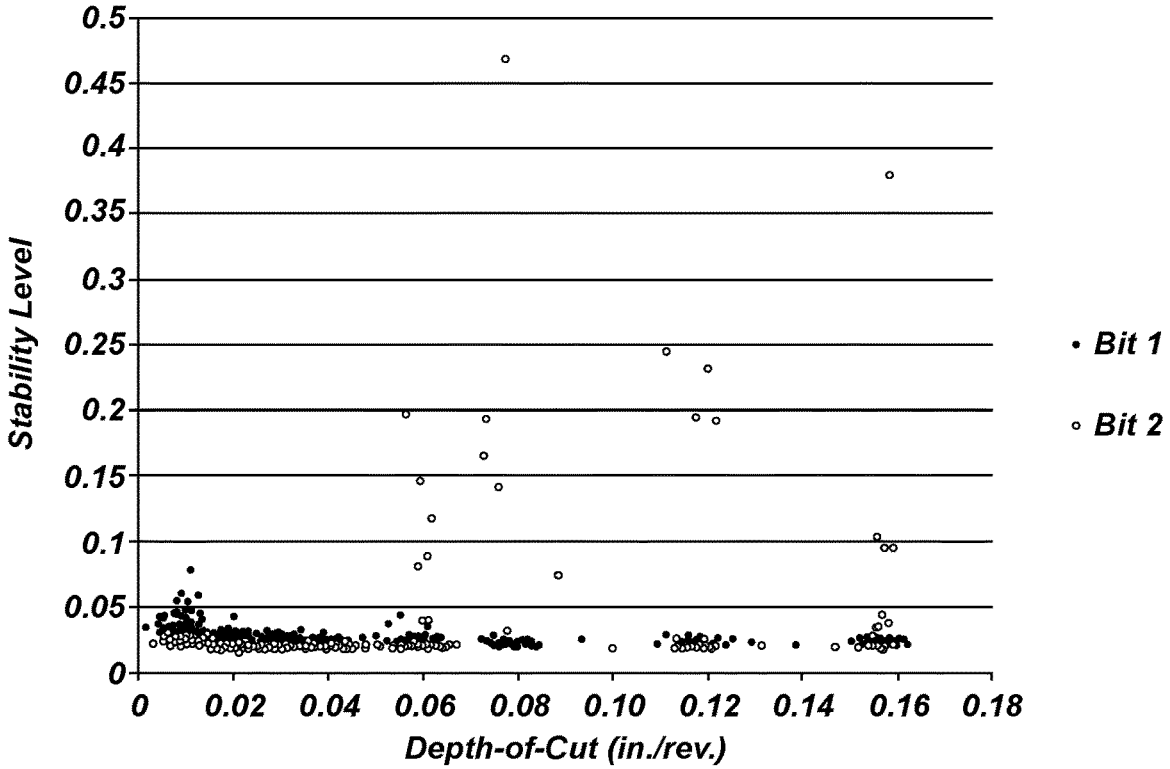
FIG. 5B is a graph depicting laboratory test results of Stability Level versus Depth-of-Cut (DOC) for the tested drill bit configurations in a second representative formation.

FIGS. 5A and 5B show graphs depicting laboratory test results for the earth-boring tool 100 configured similar to the fixed-cutter rotary drill bit of FIG. 1. In particular, the drill bits utilized during testing included an 8.75 in. drag bit (i.e., Bit 1) and an 8.5 in. drag bit (i.e., Bit 2) commercially available through Baker Hughes Incorporated of Houston, Tex., each of which included cutting elements and non-cutting bearing elements positioned on a bit body having a five-blade configuration. Other than the slight size differences, the configurations of the two bit bodies were generally the same. The focus of the testing for the specific bit configurations included a comparison of differing placement of non-cutting bearing elements (e.g., ovoids). In particular, the testing was conducted in order to ascertain results and differences between the two bit configurations, in which the comparison Bit 1 included one ovoid on each of the primary blades and Bit 2 included two ovoids on each of the primary blades. Specifically, one ovoid was placed on each of blades 1, 3, and 4 of Bit 1, while two ovoids were placed on each of blades 1, 3, and 4 of Bit 2. It may be noted that during this particular testing procedure, the tested drag bits did not involve shaped cutting elements. Rather, the test results are attributable to a comparison of the selective placement of the ovoids. As will become apparent, however, these specific test results have direct application to the present disclosure. In particular, a misplaced (i.e., overexposed) ovoid on Bit 2 during testing resulted in marked improved stability of Bit 2 by enhancing imbalance forces, which test results were unexpected.

Testing was performed in two representative formations including Alabama and Bedford formations. The test results corresponding to the Alabama formation are depicted in FIG. 5A, while the test results corresponding to the Bedford formation are depicted in FIG. 5B. Each of the test results of FIGS. 5A and 5B include data points for Bit 1 and Bit 2, respectively. Of general significance in the graphs of FIGS. 5A and 5B is that the data points obtained during testing depicted in "groups" or "clusters" tend to illustrate increased stability in each of the plots. For example, each of the plots in the graph of FIGS. 5A and 5B exhibits approximately four or five "groups" of data points. In addition, it may be noted that "noise" is typically observed at data points above 0.1 for each testing procedure, which data points may be disregarded. Rather, data points obtained during testing depicted in "groups" or "clusters" tend to illustrate increased stability in each of the plots.

FIG. 5A graphically portrays laboratory test results with respect to Stability Level versus Depth-of-Cut (DOC) (in./rev.) in the representative Alabama formation. Stability level may be measured or computed, for example, as "Whirl Traction" or "μ Variation" (i.e., coefficient of variation of the axial aggressiveness) in a given formation at a given DOC. In the present testing procedures, a stability level having a coefficient of 0.1 or below was considered to indicate a stable bit. Of significance is the magnitude of the difference in utilizing the extra set of ovoids as shown in the graph of FIG. 5A. The magnitude of the plot of data points of the configuration of Bit 2 utilizing two ovoids on each of the primary blades is less than the magnitude of the plot of data points of the comparison configuration of Bit 1 utilizing one ovoid on each of the primary blades. However, the plot of Bit 2 having the single overexposed ovoid is markedly different than the plot of Bit 1, indicating significant improvement in stability level of Bit 2 having the single misplaced (i.e., overexposed) ovoid. As shown in the graph of FIG. 5A, the configuration of Bit 2 fully stabilizes prior to 0.06 in./rev., which test results were unexpected given the slight modifications between the two bit configurations. These results are thought to be in part attributable to the single misplaced ovoid providing improved stability of the bit by enhancing imbalance forces while engaging the Alabama formation.

FIG. 5B graphically portrays laboratory test results with respect to Stability Level versus Depth-of-Cut (DOC) (in./rev.) in the representative Bedford formation. Similar to FIG. 5A, of significance in FIG. 5B is the magnitude of the difference in utilizing the extra set of ovoids. Similarly, the magnitude of the plot of data points of the configuration of Bit 2 utilizing two ovoids on each of the primary blades is less than the magnitude of the plot of data points of the comparison configuration of Bit 1 utilizing one ovoid on each of the primary blades. However, the plot of Bit 2 having the single overexposed ovoid is also markedly different than the plot of Bit 1, indicating significant improvement in stability level of Bit 2 having the single misplaced (i.e., overexposed) ovoid. As shown in the graph of FIG. 5B, the configuration of Bit 2 also fully stabilizes prior to 0.06 in./rev., which test results were unexpected given the slight modifications between the two bit configurations. These results are thought to be in part attributable to the single misplaced ovoid providing improved stability of the bit by enhancing imbalance forces while engaging the Bedford formation. Therefore, the unintended placement of the overexposed ovoid while all other remaining blades included an intended exposure of ovoids provided a significant increase in stability in each of the Alabama and Bedford formations. Thus, selective placement of second shaped inserts, exhibiting a greater exposure relative to the first shaped inserts, and/or non-cutting bearing elements in an asymmetric configuration may provide greater stability, thereby providing a novel solution to the problem of natural imbalance forces while providing the additional benefit of reducing (e.g., preventing) destructive loading of PDC cutting elements during drilling operations.

It can now be appreciated that the present disclosure is particularly suitable for applications involving earth-boring tools that might otherwise utilize conventional placement of cutting elements and/or shaped inserts. Therefore, when implementing the present disclosure by providing a bit having selective placement of shaped inserts in an asymmetric configuration among cutting elements, a bit embodying the present disclosure will optimally exhibit increased stability level for increased drilling efficiency. In particular, placement of shaped inserts on one or more adjacent blades of the bit body opposite from an imbalance force may beneficially affect stability levels, particularly in drilling harder subterranean formations.

Additional non-limiting example embodiments of the disclosure are set forth below.

Embodiment 1

An earth-boring tool, comprising: a body having a longitudinal axis; blades extending longitudinally and generally radially from the body; a plurality of primary cutting elements located on each blade; a group of at least two adjacent blades, each blade of the group of at least two adjacent blades comprising the plurality of primary cutting elements proximate a front cutting edge of the blades and at least one first shaped insert located rotationally behind the plurality of primary cutting elements; at least one additional blade comprising the plurality of primary cutting elements proximate the front cutting edge of the blades and at least one second shaped insert located rotationally behind the plurality of primary cutting elements, the at least one second shaped insert exhibiting a greater exposure relative to the at least one first shaped insert, wherein distribution of the at least one second shaped insert relative to the longitudinal axis is asymmetric with respect to the longitudinal axis of the body; and wherein the group of at least two adjacent blades is entirely free of the at least one second shaped insert.

Embodiment 2

The earth-boring tool of Embodiment 1, wherein the blades further comprise a plurality of primary blades and a plurality of secondary blades, the group of at least two adjacent blades including at least one primary blade adjacent to at least one secondary blade.

Embodiment 3

The earth-boring tool of Embodiment 1, wherein: the group of at least two adjacent blades being entirely free of the at least one second shaped insert is located on a first side of the body adjacent to the imbalance force acting on the body; and the at least one additional blade containing the at least one second shaped insert is located on a second side of the body opposite from an imbalance force acting on the body.

Embodiment 4

The earth-boring tool of Embodiment 1, wherein the at least one second shaped insert comprises two second shaped inserts located on a single blade of the at least one additional blade.

Embodiment 5

The earth-boring tool of Embodiment 1, wherein the at least one second shaped insert comprises two second shaped inserts located on each of two adjacent blades of the at least one additional blade.

Embodiment 6

The earth-boring tool of Embodiment 1, wherein the at least one second shaped insert is located in at least one of a nose region or a shoulder region of a face of the earth-boring tool while each of a cone region, a flank region, and a gage region is entirely free of the at least one second shaped insert.

Embodiment 7

The earth-boring tool of Embodiment 6, wherein the at least one second shaped insert is located in a shoulder region of the face of the earth-boring tool while a nose region of the face of the earth-boring tool is entirely free of the at least one second shaped insert.

Embodiment 8

The earth-boring tool of Embodiment 1, wherein: the plurality of primary cutting elements is located at a rotationally leading edge of a respective blade; and the at least one second shaped insert is positioned to rotationally follow the plurality of primary cutting elements on the respective blade.

Embodiment 9

The earth-boring tool of Embodiment 1, wherein: the plurality of primary cutting elements each comprises a substantially planar cutting face; and a cutting face of each of the at least one first shaped insert and the at least one second shaped insert is at least one of dome-shaped, cone-shaped, and chisel-shaped.

Embodiment 10

The earth-boring tool of Embodiment 1, wherein: a longitudinal axis of each cutting element of the plurality of primary cutting elements is oriented at an angle between about 2 degrees and about 45 degrees relative to an adjacent surface of the blades; and a longitudinal axis of each of the at least one first shaped insert and the at least one second shaped insert is oriented at an angle between about 70 degrees and about 110 degrees relative to an adjacent surface of the blades.

Embodiment 11

The earth-boring tool of Embodiment 1, wherein an exposure of the at least one first shaped insert relative to an adjacent surface of a respective blade is less than an exposure of the at least one second shaped insert relative to an adjacent surface of the respective blade.

Embodiment 12

The earth-boring tool of Embodiment 1, wherein an exposure of each of the at least one first shaped insert and the at least one second shaped insert relative to an adjacent surface of a respective blade is less than an exposure of the plurality of primary cutting elements relative to an adjacent surface of the respective blade, each of the at least one first shaped insert and the at least one second shaped insert being at least partially located behind and not exposed above a rotationally leading cutting element secured to the same blade as the at least one first shaped insert and the at least one second shaped insert.

Embodiment 13

The earth-boring tool of Embodiment 12, wherein the at least one first shaped insert is located directly rotationally behind and at least partially within a cutting path traversed by the rotationally leading primary cutting element.

Embodiment 14

The earth-boring tool of Embodiment 12, wherein the at least one second shaped insert is located adjacent to a cutting path traversed by the rotationally leading primary cutting element, the at least one second shaped insert positioned to directly engage a formation.

Embodiment 15

The earth-boring tool of Embodiment 1, wherein a height of the at least one second shaped insert is adjustable with at least one spacer inserted in a bottom of a pocket of the at least one second shaped insert.

Embodiment 16

A method of drilling a subterranean formation, comprising: applying weight-on-bit to an earth-boring tool substantially along a longitudinal axis thereof and rotating the earth-boring tool; engaging a formation with a plurality of primary cutting elements, at least one first shaped insert, and at least one second shaped insert of the earth-boring tool, the at least one second shaped insert exhibiting a greater exposure relative to the at least one first shaped insert, wherein each blade of a group of at least two adjacent blades comprises the plurality of primary cutting elements proximate a front cutting edge of the blades and the at least one first shaped insert located rotationally behind the plurality of primary cutting elements while at least one additional blade comprises the plurality of primary cutting elements proximate the front cutting edge of the blades and the at least one second shaped insert located rotationally behind the plurality of primary cutting elements, the group of at least two adjacent blades being entirely free of the at least one second shaped insert; and enhancing imbalance forces acting on the earth-boring tool using a distribution of the at least one second shaped insert relative to the longitudinal axis that is asymmetric with respect to the longitudinal axis.

Embodiment 17

The method of Embodiment 16, wherein enhancing the imbalance forces acting on the earth-boring tool comprises using the at least one second shaped insert located on at least one additional blade on a second side of a body of the earth-boring tool opposite from the imbalance forces acting on the body while each blade of the group of at least two adjacent blades being entirely free of the at least one second shaped insert is located on a first side of the body adjacent to the imbalance forces acting on the body during application of a selected weight-on-bit substantially along the longitudinal axis.

Embodiment 18

The method of Embodiment 16, wherein engaging the formation comprises shearing the formation with the plurality of primary cutting elements while gouging the formation with the at least one first shaped insert and the at least one second shaped insert.

Embodiment 19

The method of Embodiment 16, wherein engaging the formation comprises engaging the formation with the at least one second shaped insert having an exposure relative to an adjacent surface of the respective blade greater than an exposure of the at least one first shaped insert relative to an adjacent surface of the respective blade.

Embodiment 20

The method of Embodiment 16, wherein engaging the formation comprises engaging the formation with a single second shaped insert located rotationally behind the plurality of primary cutting elements, the single second shaped insert having an exposure relative to an adjacent surface of the respective blade greater than an exposure of the plurality of primary cutting elements relative to an adjacent surface of the respective blade.

Embodiment 21

The method of Embodiment 16, wherein engaging the formation comprises engaging the formation with the at least one first shaped insert and the at least one second shaped insert comprising one or more of natural diamond, polycrystalline diamond, thermally stable polycrystalline diamond, cubic boron nitride, a ceramic, a metal, a metal alloy, and a ceramic-metal composite material.

Embodiment 22

A method of drilling a subterranean formation, comprising: applying weight-on-bit to an earth-boring tool substantially along a longitudinal axis thereof and rotating the earth-boring tool; engaging a formation with a plurality of primary cutting elements and at least one shaped insert located on blades of the earth-boring tool, wherein each blade comprises the plurality of primary cutting elements proximate a front cutting edge of the blades and a single blade comprises a single shaped insert located rotationally behind the plurality of primary cutting elements while all other blades remain entirely free of the at least one shaped insert; and enhancing imbalance forces acting on the earth-boring tool using a distribution of the at least one shaped insert relative to the longitudinal axis that is asymmetric with respect to the longitudinal axis.

Although the foregoing description contains many specifics, these are not to be construed as limiting the scope of the present disclosure, but merely as providing certain exemplary embodiments. Similarly, other embodiments of the disclosure may be devised, which do not depart from the spirit or scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. An earth-boring tool, comprising:

a body having a longitudinal axis;

blades extending longitudinally and generally radially from the body;

a plurality of primary cutting elements located on each blade, each primary cutting element of the plurality of primary cutting elements comprising a substantially planar cutting face;

a group of at least two circumferentially adjacent blades, each blade of the group of at least two circumferentially adjacent blades comprising the plurality of primary cutting elements proximate a front cutting edge of the blades and at least one first shaped insert located rotationally behind the plurality of primary cutting elements;

at least one additional blade comprising the plurality of primary cutting elements proximate the front cutting edge of the blades and at least one second shaped insert located rotationally behind the plurality of primary cutting elements, each of the at least one first shaped insert and the at least one second shaped insert comprising a non-planar cutting face, and the at least one second shaped insert exhibiting a greater exposure relative to the at least one first shaped insert, wherein distribution of the at least one second shaped insert relative to the longitudinal axis of the body is asymmetric with respect to the longitudinal axis of the body; and wherein the group of at least two circumferentially adjacent blades is entirely free of the at least one second shaped insert.

2. The earth-boring tool of claim 1, wherein the blades further comprise a plurality of primary blades and a plurality of secondary blades, the group of at least two circumferentially adjacent blades including at least one primary blade circumferentially adjacent to at least one secondary blade.

3. The earth-boring tool of claim 1, wherein:

the group of at least two circumferentially adjacent blades being entirely free of the at least one second shaped insert is located on a first side of the body adjacent to an imbalance force acting on the body; and the at least one additional blade containing the at least one second shaped insert is located on a second side of the body opposite from the imbalance force acting on the body.

4. The earth-boring tool of claim 1, wherein the at least one second shaped insert comprises exactly two second shaped inserts located on a single blade of the at least one additional blade.

5. The earth-boring tool of claim 1, wherein the at least one second shaped insert comprises exactly two second shaped inserts located on each of two circumferentially adjacent blades of the at least one additional blade.

6. The earth-boring tool of claim 1, wherein the at least one second shaped insert is located in at least one of a nose region or a shoulder region of a face of the earth-boring tool while each of a cone region, a flank region, and a gage region is entirely free of the at least one second shaped insert.

7. The earth-boring tool of claim 6, wherein the at least one second shaped insert is located in a shoulder region of the face of the earth-boring tool while a nose region of the face of the earth-boring tool is entirely free of the at least one second shaped insert.

8. The earth-boring tool of claim 1, wherein:

the plurality of primary cutting elements is located at a rotationally leading edge of a respective blade; and the at least one second shaped insert is positioned to rotationally follow the plurality of primary cutting elements on the respective blade.

9. The earth-boring tool of claim 1, wherein a cutting face of each of the at least one first shaped insert and the at least one second shaped insert is at least one of dome-shaped, cone-shaped, and chisel-shaped.

10. The earth-boring tool of claim 1, wherein:

a longitudinal axis of each cutting element of the plurality of primary cutting elements is oriented at an angle between about 2 degrees and about 45 degrees relative to an adjacent surface of the blades; and a longitudinal axis of each of the at least one first shaped insert and the at least one second shaped insert is oriented at an angle between about 70 degrees and about 110 degrees relative to an adjacent surface of the blades.

11. The earth-boring tool of claim 1, wherein an exposure of the at least one first shaped insert relative to an adjacent surface of a respective blade is less than an exposure of the at least one second shaped insert relative to an adjacent surface of the respective blade.

12. The earth-boring tool of claim 1, wherein an exposure of each of the at least one first shaped insert and the at least one second shaped insert relative to an adjacent surface of a respective blade is less than an exposure of the plurality of primary cutting elements relative to an adjacent surface of the respective blade, each of the at least one first shaped insert and the at least one second shaped insert being at least partially located behind and not exposed above a rotationally leading primary cutting element secured to the same blade as the at least one first shaped insert and the at least one second shaped insert.

13. The earth-boring tool of claim 12, wherein the at least one first shaped insert is located directly rotationally behind and at least partially within a cutting path traversed by the rotationally leading primary cutting element.

14. The earth-boring tool of claim 12, wherein the at least one second shaped insert is located adjacent to a cutting path traversed by the rotationally leading primary cutting element, the at least one second shaped insert positioned to directly engage a formation.

15. The earth-boring tool of claim 1, wherein a height of the at least one second shaped insert is adjustable relative to a height of the at least one first shaped insert.

16. A method of drilling a subterranean formation, comprising:

applying weight-on-bit to an earth-boring tool substantially along a longitudinal axis thereof and rotating the earth-boring tool;

engaging a formation with a plurality of primary cutting elements, at least one first shaped insert, and at least one second shaped insert of the earth-boring tool, wherein each primary cutting element of the plurality of primary cutting elements comprises a substantially planar cutting face and each of the at least one first shaped insert and the at least one second shaped insert comprises a non-planar cutting face, the at least one second shaped insert exhibiting a greater exposure relative to the at least one first shaped insert, wherein each blade of a group of at least two circumferentially adjacent blades comprises the plurality of primary cutting elements proximate a front cutting edge of the blades and the at least one first shaped insert located rotationally behind the plurality of primary cutting elements while at least one additional blade comprises the plurality of primary cutting elements proximate the front cutting edge of the blades and the at least one second shaped insert located rotationally behind the plurality of primary cutting elements, the group of at least two circumferentially adjacent blades being entirely free of the at least one second shaped insert; and enhancing imbalance forces acting on the earth-boring tool using a distribution of the at least one second shaped insert relative to the longitudinal axis of the earth-boring tool that is asymmetric with respect to the longitudinal axis of the earth-boring tool.

17. The method of claim 16, wherein enhancing the imbalance forces acting on the earth-boring tool comprises using the at least one second shaped insert located on at least one additional blade on a second side of a body of the earth-boring tool opposite from the imbalance forces acting on the body while each blade of the group of at least two circumferentially adjacent blades being entirely free of the at least one second shaped insert is located on a first side of the body adjacent to the imbalance forces acting on the body during application of a selected weight-on-bit substantially along the longitudinal axis of the earth-boring tool.

18. The method of claim 16, wherein engaging the formation comprises shearing the formation with the plurality of primary cutting elements while gouging the formation with the at least one first shaped insert and the at least one second shaped insert.

19. The method of claim 16, wherein engaging the formation comprises engaging the formation with the at least one second shaped insert having an exposure relative to an adjacent surface of the respective blade greater than an exposure of the at least one first shaped insert relative to an adjacent surface of the respective blade.

20. The method of claim 16, wherein engaging the formation comprises engaging the formation with a single second shaped insert located rotationally behind the plurality of primary cutting elements, the single second shaped insert having an exposure relative to an adjacent surface of the respective blade greater than an exposure of the plurality of primary cutting elements relative to an adjacent surface of the respective blade.

21. The method of claim 16, wherein engaging the formation comprises engaging the formation with the at least one first shaped insert and the at least one second shaped insert comprising one or more of natural diamond, polycrystalline diamond, thermally stable polycrystalline diamond, cubic boron nitride, a ceramic, a metal, a metal alloy, and a ceramic-metal composite material.

22. A method of drilling a subterranean formation, comprising:

applying weight-on-bit to an earth-boring tool substantially along a longitudinal axis thereof and rotating the earth-boring tool;

engaging a formation with a plurality of primary cutting elements and a single shaped insert located on blades of the earth-boring tool, wherein each blade comprises the plurality of primary cutting elements proximate a front cutting edge of the blades and a single blade comprises the single shaped insert located rotationally behind the plurality of primary cutting elements while all other blades remain entirely free of the single shaped insert, wherein each primary cutting element of the plurality of primary cutting elements comprises a substantially planar cutting face and the single shaped insert comprises a non-planar cutting face; and enhancing imbalance forces acting on the earth-boring tool using a distribution of the single shaped insert relative to the longitudinal axis of the earth-boring tool that is asymmetric with respect to the longitudinal axis of the earth-boring tool.

* * * * *